US009332849B2

(12) United States Patent
Wagner et al.

(10) Patent No.: US 9,332,849 B2
(45) Date of Patent: May 10, 2016

(54) COLLAPSIBLE CHAIR HAVING A REMOVABLE SEAT PAD

(71) Applicant: American Recreation Products, LLC., Boulder, CO (US)

(72) Inventors: Matt Wagner, Boulder, CO (US); Scott Neilson, Boulder, CO (US)

(73) Assignee: Exxel Outdoors, LLC, Boulder, CO (US)

( * ) Notice: Subject to any disclaimer, the term of this patent is extended or adjusted under 35 U.S.C. 154(b) by 0 days.

(21) Appl. No.: 14/478,688

(22) Filed: Sep. 5, 2014

(65) Prior Publication Data

US 2015/0137566 A1 May 21, 2015

Related U.S. Application Data

(60) Provisional application No. 61/904,635, filed on Nov. 15, 2013.

(51) Int. Cl.

| | |
|---|---|
| ***A47C 7/02*** | (2006.01) |
| ***A47B 83/02*** | (2006.01) |
| ***A47C 7/70*** | (2006.01) |
| ***A47C 4/28*** | (2006.01) |

(52) U.S. Cl.

CPC ..... *A47C 7/021* (2013.01); *A47B 83/02* (2013.01); *A47C 4/283* (2013.01); *A47C 7/70* (2013.01)

(58) Field of Classification Search

CPC ..... A47C 7/62; A47C 7/66; A47C 7/74; A47C 7/72; A47C 7/742; A47C 7/746; A47C 7/748; A47C 4/283; A47C 4/42; A47C 4/52; A47C 31/116; A47C 3/16; A47C 7/70; A47B 83/02

USPC ..... 297/45, 56, 60, 35, 180.1, 180.11, 297/180.12, 180.14, 4, 17, 16.1, 16.2

See application file for complete search history.

(56) References Cited

U.S. PATENT DOCUMENTS

| | | | | |
|---|---|---|---|---|
| 1,756,551 | A * | 4/1930 | Hayes | 248/436 |
| 2,253,801 | A * | 8/1941 | Neal | 5/710 |
| 2,617,473 | A | 11/1952 | Krimstock et al. | |
| 3,638,255 | A * | 2/1972 | Sterrett | 5/641 |
| 4,108,492 | A * | 8/1978 | Kirby | 297/284.3 |
| 4,474,407 | A * | 10/1984 | Nazar | 297/188.13 |
| 4,604,987 | A * | 8/1986 | Keltner | 126/204 |
| 4,650,245 | A * | 3/1987 | Nazar | 297/188.13 |
| 5,545,198 | A * | 8/1996 | Owens | 607/108 |
| 5,873,624 | A | 2/1999 | Simpson | |
| 6,048,023 | A * | 4/2000 | Lampton | 297/129 |

(Continued)

OTHER PUBLICATIONS

Deluxe Oasis Zero Tipping Stadium Seat W/One Removable Soft Stadium Cushion, http://www.amazon.com/Oasis-Removable-Cushion-5-Warranty-High-Product-Buy/dp/B002ZW5XBW, Aug. 22, 2014.

*Primary Examiner* — Beth Stephan

(74) *Attorney, Agent, or Firm* — Stinson Leonard Street LLP

(57) ABSTRACT

A collapsible chair has a frame selectively moveable between a collapsed configuration of the chair and an extended configuration of the chair, and a seat that is coupled to the frame. The seat has a first material layer and a second material layer wherein the first layer and the second layer cooperatively define a seat pocket. A seat pad is selectively moveable between a stored configuration wherein the seat pad is located in the seat pocket and a portable configuration inside the seat membrane pocket and a portable configuration, wherein the seat pad is removed from the seat pocket and usable as a portable seat pad.

16 Claims, 7 Drawing Sheets

(56) References Cited

U.S. PATENT DOCUMENTS

| | | | | |
|---|---|---|---|---|
| 6,073,998 | A * | 6/2000 | Siarkowski et al. | 297/180.12 |
| 6,364,411 | B1 | 4/2002 | Zheng | |
| 6,550,855 | B2 | 4/2003 | Liu | |
| 6,588,840 | B1 | 7/2003 | Lombardo | |
| 6,814,408 | B2 | 11/2004 | Chen | |
| 6,848,746 | B2 * | 2/2005 | Gentry | 297/380 |
| 6,976,733 | B1 | 12/2005 | Biederman et al. | |
| 7,232,184 | B2 * | 6/2007 | Lawler | 297/228.1 |
| 7,774,880 | B1 * | 8/2010 | Botts | 5/656 |
| 7,866,743 | B1 * | 1/2011 | Russell et al. | 297/180.12 |
| 8,388,056 | B2 * | 3/2013 | Smith et al. | 297/180.12 |
| 8,499,388 | B1 | 8/2013 | Copes | |
| 8,556,337 | B1 * | 10/2013 | Cornitius-Cary | 297/180.11 |
| 8,801,091 | B2 * | 8/2014 | Squires et al. | 297/180.14 |
| 8,864,221 | B1 * | 10/2014 | Delvilla | 297/31 |
| 8,870,281 | B1 * | 10/2014 | Boone | 297/180.1 |
| 2001/0027334 | A1 * | 10/2001 | White | 607/108 |
| 2004/0075311 | A1 * | 4/2004 | Linder | 297/188.04 |
| 2009/0072594 | A1 * | 3/2009 | Korytowski | 297/180.12 |
| 2011/0127815 | A1 * | 6/2011 | Nickerson | 297/217.1 |
| 2012/0187732 | A1 * | 7/2012 | Lerm | 297/219.12 |
| 2012/0313405 | A1 * | 12/2012 | Eckman et al. | 297/180.12 |
| 2014/0008945 | A1 * | 1/2014 | Widmann | 297/180.11 |

* cited by examiner

COLLAPSIBLE CHAIR HAVING A REMOVABLE SEAT PAD

CROSS-REFERENCE TO RELATED APPLICATION

This nonprovisional application claims priority to U.S. Provisional Patent Application Ser. No. 61/904,635, filed on Nov. 15, 2013, which is hereby incorporated by reference in its entirety.

FIELD

The field of this disclosure relates generally to collapsible chairs, and more particularly, to collapsible chairs having a removable, cushioned seat pad.

BACKGROUND

Known collapsible chairs are popular because they can be readily folded, transported, and stored. Such features enable collapsible chairs to be transported and used during outdoor recreational activities, such as sporting events, concerts, etc. Spectators at such events often use collapsible chairs while engaging in social activities in a venue's parking areas (such as "tailgating") before and/or after the event. At least some known collapsible chairs include a frame that is selectively moveable between a collapsed or folded configuration when the chair is not in use and an extended configuration during use. Such collapsible chairs are significantly large when in use (i.e., in its extended configuration) as compared to its collapsed configuration. Many venues do not allow spectators to bring in such collapsible chairs because seating is often provided.

Bleacher-type seating is provided at many venues for spectators of sporting events, concerts, etc. While bleacher-type seating can provide simple, convenient seating for a large number of spectators, it does not generally provide comfortable seating. To improve the comfort of bleacher-type seating, spectators sometimes bring their own portable seats or cushions. A spectator who chooses to participate in tailgating activities and who chooses to use his or her own portable cushion in the venue is required to bring two of their own devices to the event, which requires additional storage room in a vehicle. Therefore, there is a need to provide convenient, portable, and comfortable seating for the spectator both inside and outside of the venue.

SUMMARY

In one aspect, a collapsible chair generally comprises a frame selectively moveable between a collapsed configuration of the chair and an extended configuration of the chair. The chair also includes a seat that is coupled to the frame. The seat includes a first material layer and a second material layer, the first layer and the second layer cooperatively defining a seat pocket. A seat pad is selectively moveable between a stored configuration, wherein the seat pad is located in the seat pocket, and a portable configuration, wherein the seat pad is removed from the seat pocket and usable as a portable seat pad.

In another aspect, a method of using a collapsible chair having a removable seat pad generally comprises moving a frame from a collapsed configuration of the chair to an extended configuration of the chair. A seat is coupled to the frame and defines a seat pocket configured to receive a seat pad. The method also includes moving the seat pad between a stored configuration wherein the seat pad is located in the seat pocket and a portable configuration wherein the seat pad is removed from the seat pocket to provide a user a portable seat pad.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Corresponding reference characters indicate corresponding parts throughout the several views of the drawings.

DETAILED DESCRIPTION OF THE DRAWINGS

Figure 1:
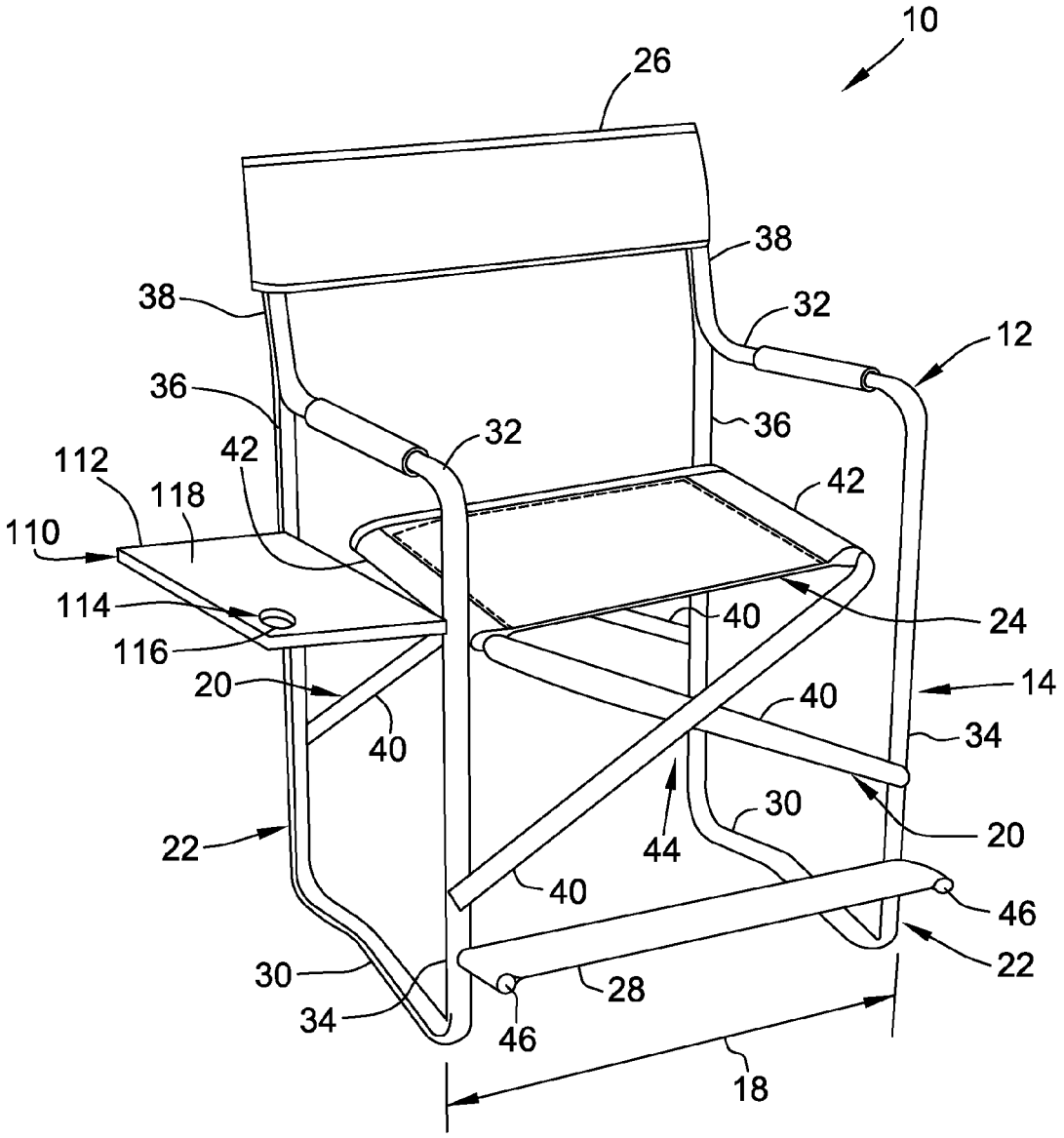
FIG. 1 is a perspective of one suitable embodiment of a collapsible chair having a removable, cushioned seat pad, the chair being in an extended configuration.

Referring now to the drawings and in particular to FIGS. 1-7, one suitable embodiment of a collapsible chair is designated in its entirety by reference number 10. While FIGS. 1-7 illustrate an exemplary collapsible chair, generally referred to as a captain's chair, it is understood that the removable, cushioned seat pad systems and methods described herein are not limited to any one particular type of collapsible chair. One of ordinary skill in the art should appreciate that the removable, cushioned seat pad systems and methods described herein may be used with any suitable collapsible chair, including a collapsible quad chair.

Figure 2:
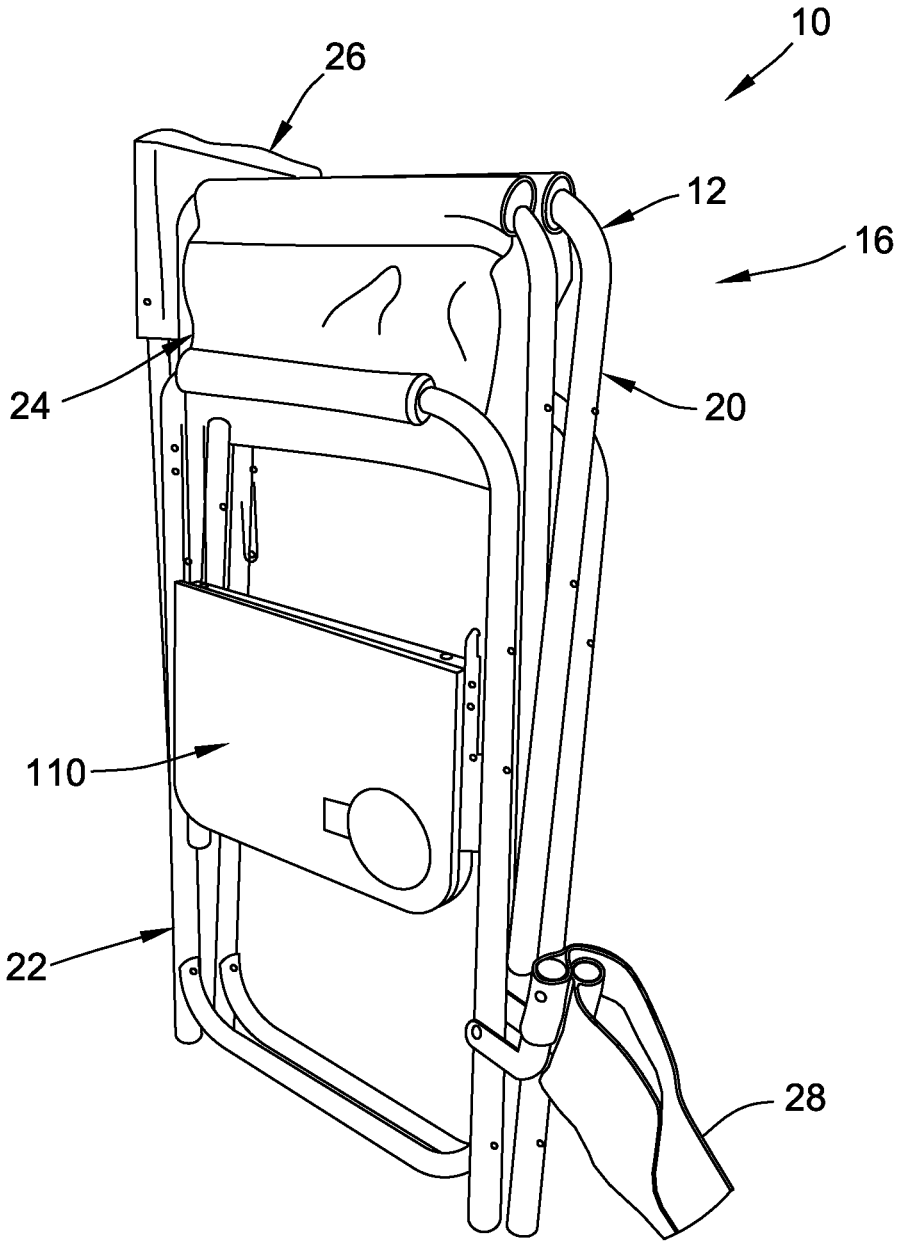
FIG. 2 is a perspective of the collapsible chair in a collapsed configuration.
Figure 3:
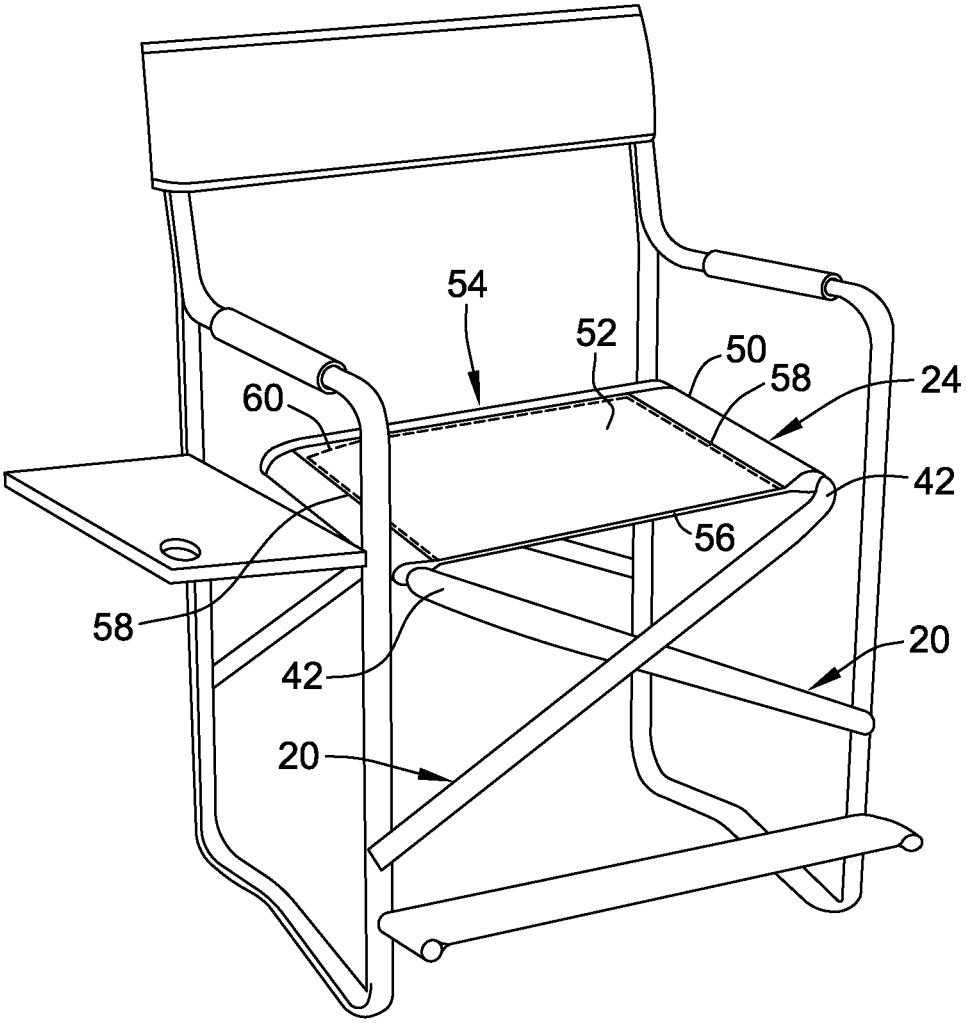
FIG. 3 is another perspective of the collapsible chair shown in FIG. 1.

As seen in FIGS. 1-3, the collapsible chair 10 includes a frame 12 selectively moveable between an extended, use configuration 14, as seen in FIG. 1, and a collapsed, stored configuration 16, as seen in FIG. 2. In the extended configuration 14, the frame 12 extends a width 18. The frame 12 may be folded, for example, to form the collapsed configuration 16 such that the width 18 of the frame 12 is substantially decreased and the collapsible chair 10 may be stored in, for example, a closet or a trunk of a car. The frame 12 can be moved from the collapsed configuration 16 to the extended configuration 14 wherein the width 18 of the frame 12 is substantially increased and a user may sit on the collapsible chair 10. The frame 12 may be made from plastic, metal (e.g., steel, aluminum, etc.), or any suitable material that enables the collapsible chair 10 to function as described herein.

In the exemplary embodiment, the frame 12 includes a plurality of connecting structures 20 coupled between a pair of outer frames 22. A seat 24, a back support 26, and a foot support 28 are coupled to the frame 12. More specifically, the back support 26 and the foot support 28 are coupled between the outer frames 22, and the seat 24 is coupled between the two connecting structures 20. Accordingly, during use of the collapsible chair 10, the user may be seated on the seat 24, may position his or her back against the back support 26, and may position his or her feet on the foot support 28. In the exemplary embodiment, the seat 24 and the back support 26 are formed as separate pieces. It is understood, however, that the seat 24 and the back support 26 may be formed as a single-piece.

In the illustrated embodiment, each outer frame 22 is generally rectangular in shape and comprises a pair of horizontal members, i.e., a lower horizontal member 30 and an upper horizontal member 32, and a pair of vertical members, i.e., a front vertical member 34 and a rear vertical member 36. The rear vertical member 36 includes an upward extending portion 38 that extends beyond the upper horizontal member 32. Each of the front vertical members 34 includes a lower foot peg 46 extending forward, transverse to the vertical member 34. As seen in FIG. 1, the back support 26 is coupled to the upward extending portions 38, and the foot support 28 is coupled to the lower foot pegs 46.

In the illustrated embodiment, the connecting structures 20 are pivotably coupled to the outer frames 22. More specifically, each connecting structure 20 has a pair of connecting legs 40 and a horizontal member 42. Each connecting leg 40 is pivotably coupled to a lower portion of the respective vertical member 34, 36 of the outer frame 22. Furthermore, the connecting structures 20 are pivotably coupled to each other in a crisscrossed configuration. In the illustrated embodiment, the central portion of each connecting leg 40 of one connecting structure 20 is pivotably coupled to a central portion of each connecting leg 40 of the other connecting structure 20, such that in the extended configuration 14, the connecting structures 20 form an X-shaped structure 44. The seat 24 is coupled to the horizontal members 42 of the connecting structures 20.

In the illustrated embodiment, the seat 24, the back support 26, and the foot support 28 each comprise at least one layer of a suitable material. For example, the seat 24, the back support 26, and the foot support 28 may be made from a wide selection of materials, such as, but not limited to, synthetic materials (for example, polyester or polypropylene materials), natural materials (for example, wood or cotton materials), and/or a combination of natural and synthetic materials.

As illustrated in FIG. 3, the seat 24 is substantially rectangular in shape and includes at least a first material layer 50 coupled to the horizontal members 42 of the connecting structures 20, and a second material layer 52 configured to cover at least a portion of the first material layer 50. The first material layer 50 and the second material layer 52 may be joined together at a plurality of seams 58 parallel to and located proximate the horizontal members 42 of the connecting structures 20, for example, by sewing, adhesive bonding, heat welding, or other bonding technique along the length of the seams 58. In one suitable embodiment, the seat 24 can be made from a single piece of material such that the second material layer 52 is folded approximately 180 degrees along a front edge 56 of the seat 24 so the second material layer 52 is in a face-to-face relationship with the first material layer 50. In another suitable embodiment, the seat 24 may be made from separate pieces of material, wherein the first material layer 50 and the second material layer 52 are joined together at the front edge 56, for example, by sewing, adhesive bonding, heat welding, or other bonding technique along the length of the front edge 56. In the illustrated embodiment, the second material layer 52 also includes a free edge 60, i.e., the free edge 60 is not coupled to the first material layer 50, thus forming a substantially rectangular-shaped pocket 54 in the seat 24.

In the illustrated embodiment, a seat pad 70 (FIGS. 4 and 5) is substantially rectangular in shape and configured to be inserted in the pocket 54 of the seat 24 to provide a padded seat for the collapsible chair 10. The pocket 54 of the seat 24 is configured to receive and store the seat pad 70 therein. Specifically, the pocket 54 is configured to hold the seat pad 70 within the pocket by the tension of the seat 24, i.e., the illustrated pocket does not include a closure device. It is understood, however, that the pocket 54 can include a closure device configured to selectively open and close the pocket, such as, without limitation, a zipper, a drawstring, a hook-and-loop fastener, or any suitable closure device that enables the pocket 54 to be selectively opened and closed.

Figure 5:
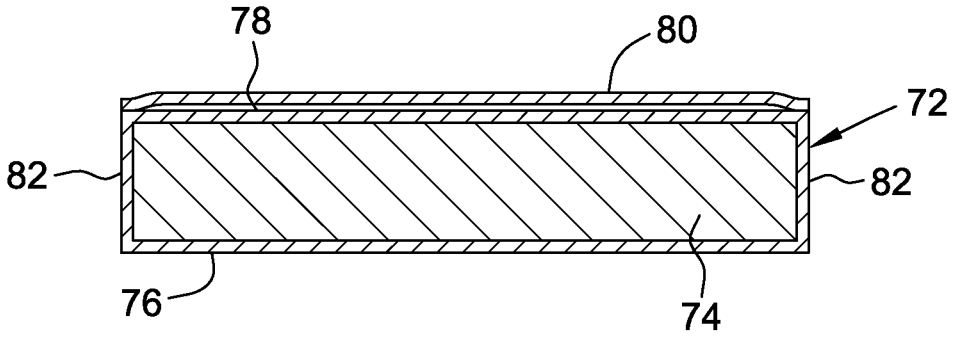
FIG. 5 is a cross-section of the removable, cushioned seat pad taken along 5-5 of FIG. 4.

The seat pad 70 is also configured to be used separate from the collapsible chair 10 to provide a portable, comfortable seat for the user. With reference to FIG. 5, the seat pad 70 includes a covering 72 and a filling material 74. The covering 72 comprises a plurality of panels, including a lower panel 76, an upper panel 78, a pocket panel 80 overlying in face-to-face relationship the upper panel 78, and four side panels 82. The panels 76, 78, 80, 82 may be joined together, for example, by sewing, adhesive bonding, heat welding, or other suitable bonding technique. The panels 76, 78, 80, 82 may be made from a wide selection of materials, such as, but not limited to, synthetic materials (for example, polyester or polypropylene materials), natural materials (for example, wood or cotton materials), and/or a combination of natural and synthetic materials. In one suitable embodiment, the panels 76, 78, 80, 82 are made from a durable waterproof material.

In the illustrated embodiment, the filling material 74 is fully enclosed within the covering 72 by the lower panel 76, the upper panel 78, and the side panels 82. The side panels 82 are connected to the upper panel 78 and the lower panel 76, and cooperatively extend around the periphery of the upper panel 78 and the lower panel 76. In one suitable embodiment, the filling material 74 comprises foam for providing cushioning to the user. Examples of suitable foam include a closed-cell polyolefin foam, a polyethylene foam, a low-resilience polyurethane foam, a foam with a negative Poisson's ratio, and other similar foams. In addition, the filling material 74 may include a single density material, or a material made from a plurality of different density materials, such as, without limitation, a dual-density foam. In another suitable embodiment, the filling material 74 may include air, whereby the covering 72 is configured as an inflatable air bladder, configured to be selectively inflated and deflated.

In the illustrated embodiment, the pocket panel 80 of the covering 72 overlaps at least a portion of the upper panel 78. The pocket panel 80 includes a free edge 88, i.e., the free edge 88 is not coupled to the upper panel 78, thus forming a substantially rectangular-shaped pocket 90 in the seat pad 70.

Figure 4:
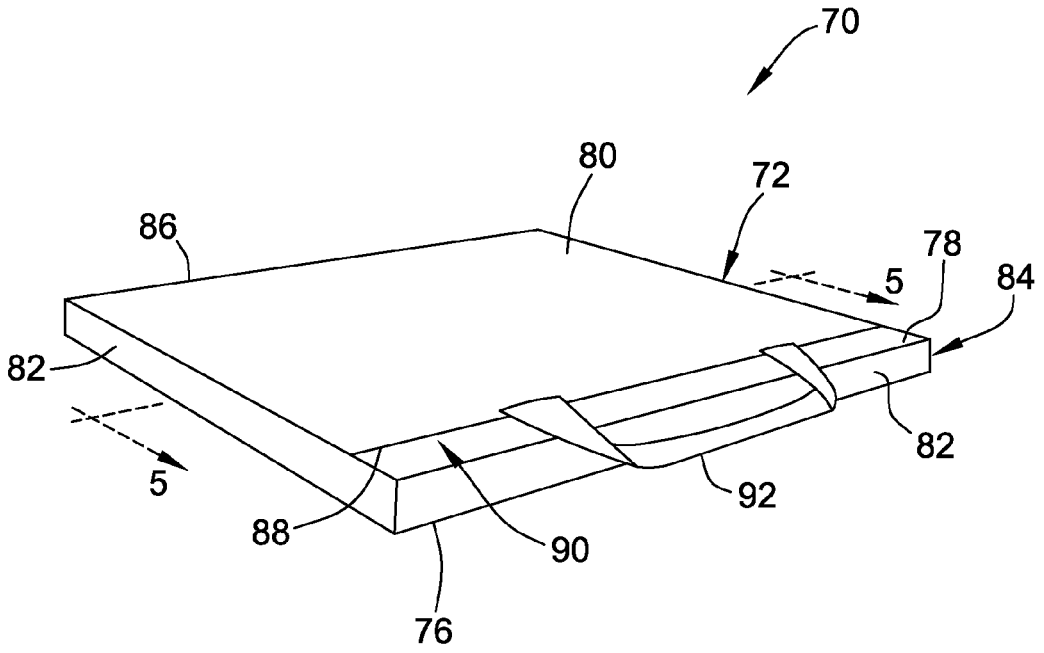
FIG. 4 is a perspective of one suitable embodiment of a removable, cushioned seat pad for use with the collapsible chair shown in FIG. 1.

As seen in FIG. 4, the pocket panel 80 includes a handle 92 coupled to the free edge 88 thereof. In the illustrated embodiment, the handle 92 is formed as a loop with the ends of the loop being coupled to the free edge 88 of the pocket panel 80 for example, by sewing, adhesive bonding, heat welding, or other suitable bonding technique. In operation, the handle 92 facilitates removing the seat pad 70 from the pocket 54 of the collapsible chair 10. The user may then transport the seat pad 70 using the handle 92. The handle 92 also facilitates opening of the pocket 90 of the seat pad 70 for inserting and/or organizing various objects, for example, without limitation, a heating/cooling element.

Figure 6:
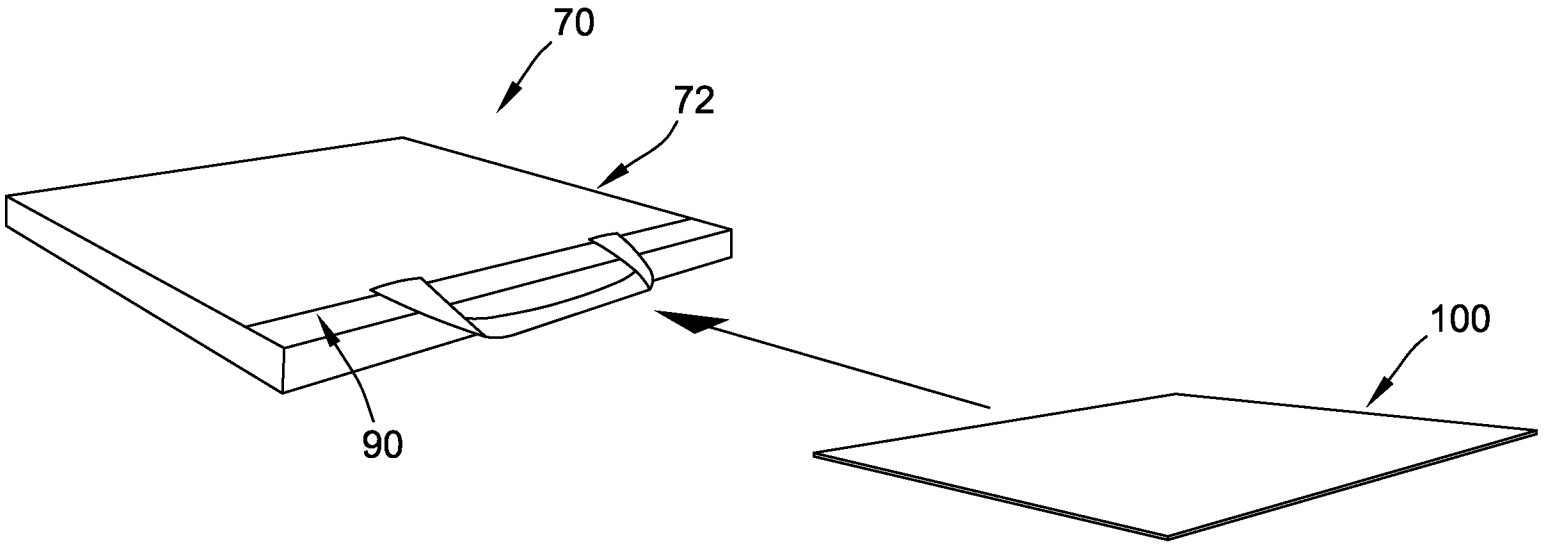
FIG. 6 is a perspective of one suitable embodiment of a heating/cooling element for use with the removable, cushioned seat pad shown in FIG. 4.

FIG. 6 illustrates one suitable embodiment of a heating/cooling element 100 that can be used with the seat pad 70. In the illustrated embodiment, the element 100 is substantially rectangular in shape, flexible, and configured to fit within the pocket 90 of the seat pad 70. The element 100 may be one of a wide selection of heating/cooling elements, such as, but not limited to, air-activated elements, chemically-activated elements, mechanically-activated elements, and/or electrical elements, that are capable of altering the temperature of the heating/cooling element. The pocket 90 of the seat pad 70 is configured to receive and store the heating/cooling element 100 therein. Specifically, the pocket 90 is configured to hold the element 100 within the pocket by the tension of the covering 72, i.e., the illustrated pocket does not include a closure device. It is understood, however, that the pocket 90 may include a closure device configured to selectively open and close the pocket, such as, without limitation, a zipper, a drawstring, a hook-and-loop fastener, or any suitable closure device that enables the pocket 90 to be selectively opened and closed.

Referring again to FIG. 1, the illustrated chair 10 comprises a tray assembly 110 comprising a plate 112 and a cup holder 114 hingedly coupled to the frame 12. In the illustrated embodiment, the tray assembly 110 extends from the outer frame 22 and is hingedly coupled to the front vertical member 34 and the rear vertical member 36, respectively. The cup holder 114 is integrally formed within the plate 112. It is contemplated that the cup holder 114 can be omitted from the plate 112. It is also contemplated that tray assembly 110 can be positioned on either side of the collapsible chair 10. In the illustrated embodiment, for example, the tray assembly 110 is positioned on the right side of the collapsible chair 10 (as viewed in FIG. 1), however, it is contemplated that the tray assembly 110 may be positioned on the left side of the collapsible chair 10. It is further contemplated that the tray assembly 110 may be positioned on both outer frames 22. That is, the collapsible chair 10 may have two tray assemblies 110.

The plate 112 is sized and shaped to enable the user to rest a dish of food (e.g., a paper or plastic disposable plate) while eating a meal while sitting in the collapsible chair 10. While the illustrated plate 112 is rectangular in shape, it should be appreciated that the plate 112 can have any suitable shape. The plate 112 may be fabricated from plastic, metal (e.g., steel, aluminum, etc.), or any suitable material that enables the tray assembly 110 to function as described herein. It is also contemplated that an upper surface 118 of the plate 112 may be formed by or coated with a material (e.g., an elastomeric material, a rubber material, etc.) to increase friction between the plate 112 and objects placed thereon.

The cup holder 114 comprises a substantially circular pocket 116 defined within the upper surface 118 of the plate 112. The pocket 116 extends a predetermined depth below the upper surface 118 of the plate 112. Accordingly, a cylindrical object (e.g., a cup, a can, a bottle, etc.) may be positioned within the pocket 116. It is contemplated that in some embodiments of the collapsible chair 10, the tray assembly 110 can be omitted.

Figure 7:
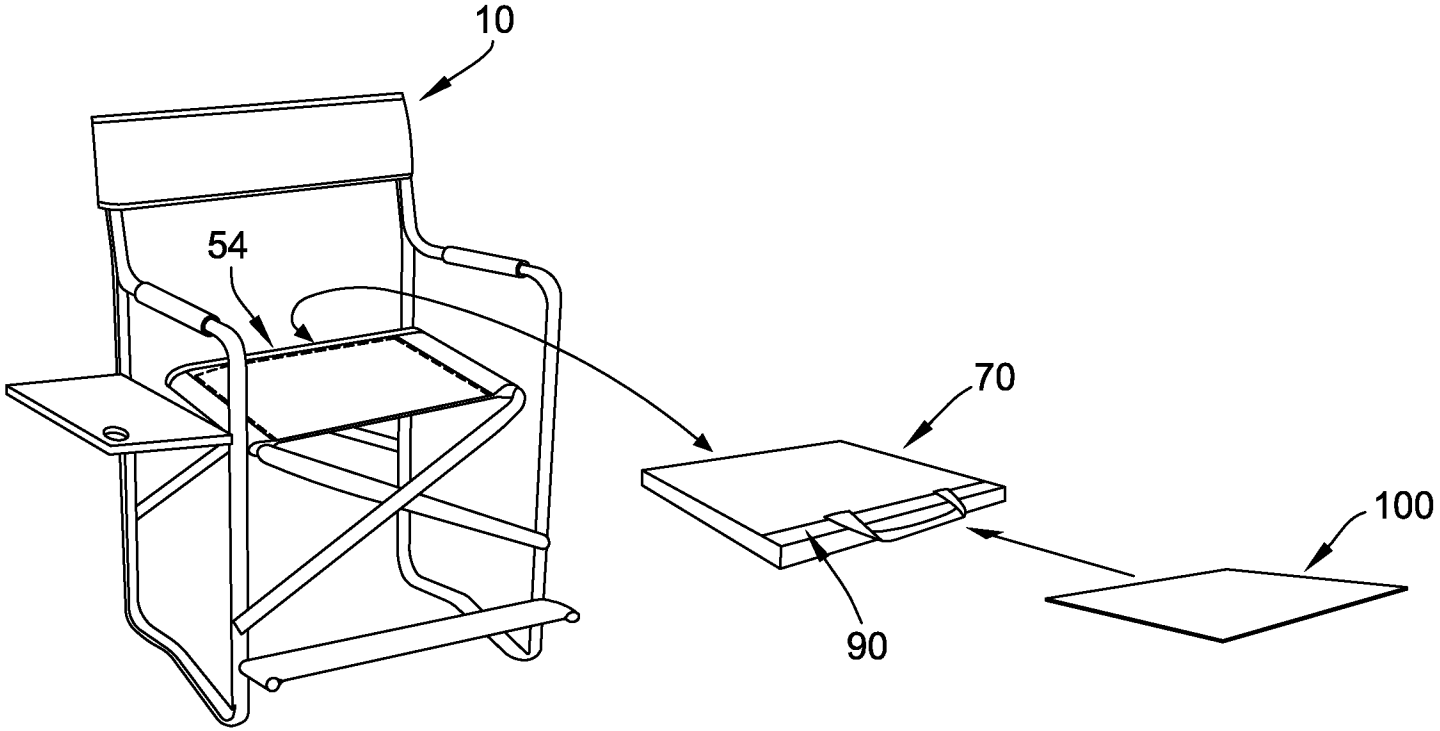
FIG. 7 is a perspective of the collapsible chair of FIG. 1 showing the seat pad of FIG. 4 and the heating/cooling element of FIG. 6 removed from the chair.

FIG. 7 is a perspective of the collapsible chair 10 showing the seat pad 70 and the heating/cooling element 100 removed from the chair 10. In one suitable embodiment, the heating/cooling element 100 is slidingly received within the pocket 90 of the seat pad 70. Thus, the element 100 can be used to provide a heated and/or cooled seat pad 70 to the user. In use, the seat pad 70 may be inserted into pocket 54 of the collapsible chair 10 in a stored configuration, or optionally may be used in a portable configuration as a seat pad for use without the collapsible chair 10, such as, without limitation, with several types of stadium seating, e.g., a bleacher seat, a folding seating, etc.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description and shown in the accompanying drawings shall be interpreted as illustrative and not in a limiting sense.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A collapsible chair comprising:

a frame selectively moveable between a collapsed configuration of the chair and an extended configuration of the chair;

a seat coupled to the frame, the seat comprising a first material layer and a second material layer, the first material layer and the second material layer cooperatively defining a seat pocket in a front of the seat; and a seat pad selectively moveable between a stored configuration, wherein the seat pad is located in the seat pocket, and a portable configuration, the seat pad comprises a handle, a seat pad pocket, and a pocket panel partially defining the seat pad pocket, wherein the handle is coupled to the pocket panel to facilitate opening the seat pad pocket, and wherein the seat pad is removed from the seat pocket and usable as a portable seat pad.

2. The collapsible chair in accordance with claim 1 further comprising a heating/cooling element.

3. The collapsible chair in accordance with claim 2, wherein the seat pad pocket is configured to receive and store the heating/cooling element therein.

4. The collapsible chair in accordance with claim 2, wherein the heating/cooling element is one of an air-activated element, a chemically-activated element, a mechanically-activated element, and an electrical element.

5. The collapsible chair in accordance with claim 2, wherein the heating/cooling element is moveable between the stored configuration inside the seat pad pocket and the portable configuration outside the seat pad pocket.

6. The collapsible chair in accordance with claim 1, wherein the seat pad further comprises a membrane covering and a filling material.

7. The collapsible chair in accordance with claim 6, wherein the filling material comprises a foam material.

8. The collapsible chair in accordance with claim 6, wherein the membrane covering is configured as an inflatable air bladder configured to be selectively inflated and deflated.

9. The collapsible chair in accordance with claim 1 further comprising a tray assembly coupled to the frame.

10. The collapsible chair in accordance with claim 9, wherein the tray assembly comprises a cup holder.

11. A method of using a collapsible chair having a portable seat pad, the method comprising:

moving a frame from a collapsed configuration of the chair to an extended configuration of the chair, wherein a seat is coupled to the frame and defines a seat pocket configured to receive a seat pad; and moving the seat pad between a stored configuration wherein the seat pad is located in the seat pocket and a portable configuration, the seat pad comprises a handle, a seat pad pocket, and a pocket panel partially defining the seat pad pocket, wherein the handle is coupled to the pocket panel to facilitate opening the seat pad pocket, and wherein the seat pad is removed from the seat pocket to provide a user the portable seat pad.

12. The method in accordance with claim 11 further comprising providing a heating/cooling element configured to be received within the seat pad pocket.

13. The method in accordance with claim 12 further comprising:

altering the temperature of the heating/cooling element; and moving the heating/cooling element between a portable configuration outside the seat pad pocket and a stored configuration inside the seat pad pocket.

14. The method in accordance with claim 11, wherein the seat pad includes a membrane covering and a foam filling material.

15. The method in accordance with claim 11, wherein the seat pad includes a membrane covering configured as an inflatable air bladder.

16. The method in accordance with claim 15 further comprising inflating the inflatable air bladder of the seat pad.

* * * * *